US011344930B2

(12) United States Patent
Rauckhorst, III

(10) Patent No.: US 11,344,930 B2
(45) Date of Patent: May 31, 2022

(54) SELF-CENTERING CONDUIT CLEANING DEVICE WITH REDUCED AXIAL LENGTH

(71) Applicant: LSQ Manufacturing, Inc., Medina, OH (US)

(72) Inventor: Richard L. Rauckhorst, III, Medina, OH (US)

(73) Assignee: LSQ Manufacturing, Inc., Medina, OH (US)

( * ) Notice: Subject to any disclaimer, the term of this patent is extended or adjusted under 35 U.S.C. 154(b) by 0 days.

(21) Appl. No.: 17/177,124

(22) Filed: Feb. 16, 2021

(65) Prior Publication Data

US 2021/0252563 A1 Aug. 19, 2021

Related U.S. Application Data

(60) Provisional application No. 62/977,364, filed on Feb. 16, 2020.

(51) Int. Cl.

| | |
|---|---|
| ***B08B 9/053*** | (2006.01) |
| ***B08B 9/049*** | (2006.01) |
| ***B08B 9/057*** | (2006.01) |

(52) U.S. Cl.

CPC ..... *B08B 9/057* (2013.01); *B08B 9/0497* (2013.01); *B08B 9/0535* (2013.01); *B08B 2209/053* (2013.01)

(58) Field of Classification Search

CPC ... B08B 9/0436; B08B 9/0497; B08B 9/0535; B08B 2209/053

See application file for complete search history.

(56) References Cited

U.S. PATENT DOCUMENTS

| | | | | |
|---|---|---|---|---|
| 1,628,070 A * | 5/1927 | Sladden | ..... | B08B 9/0497 15/104.061 |
| 1,717,986 A | 6/1929 | Liebau | | |
| 2,336,293 A * | 12/1943 | Pletcher | ..... | B08B 9/0497 134/22.12 |
| 2,358,557 A | 9/1954 | Boyd et al. | | |
| 3,056,155 A | 10/1962 | Harmes | | |

(Continued)

FOREIGN PATENT DOCUMENTS

| | | |
|---|---|---|
| EP | 0 077 562 | 4/1983 |
| EP | 0 314 629 | 5/1989 |

(Continued)

*Primary Examiner* — Randall E Chin

(74) *Attorney, Agent, or Firm* — Fay Sharpe LLP

(57) ABSTRACT

A conduit cleaning device includes a body with a central portion, a forward portion comprising a neck, and a rear portion with a hose fitting adapted for connection to an associated hose. The body includes a main flow passage that extends through the hose fitting, through the central portion, and into the neck. A rotor is rotatably supported on the neck. The rotor includes at least one rotor nozzle orifice in fluid communication with the main flow passage. A centering device is secured to the central portion of the body. The centering device includes a core and a plurality of fins that project outwardly from the core. The core of the centering device includes a mounting bore that extends therethrough, wherein at least part of the hose fitting is located within the mounting bore of the core and an annular space is defined between the hose fitting and an inner surface of the mounting bore of the core.

19 Claims, 7 Drawing Sheets

(56) References Cited

U.S. PATENT DOCUMENTS

| | | | | |
|---|---|---|---|---|
| 3,134,120 | A | 5/1964 | Brown | |
| 3,740,785 | A * | 6/1973 | Latall | B08B 9/0497 15/104.12 |
| 4,073,302 | A | 2/1978 | Jones | |
| 4,164,325 | A | 8/1979 | Watson | |
| 4,206,313 | A | 6/1980 | Cavoretto | |
| 4,531,250 | A | 7/1985 | Watanabe | |
| 4,677,997 | A | 7/1987 | Strauss | |
| 4,700,422 | A | 10/1987 | Russell | |
| 4,718,142 | A | 1/1988 | Wahlers | |
| 4,764,180 | A | 8/1988 | Shaddock | |
| 4,766,631 | A | 8/1988 | Crane et al. | |
| 4,819,314 | A | 4/1989 | Shaddock | |
| 4,821,961 | A | 4/1989 | Shook | |
| 4,985,763 | A | 1/1991 | Fraser | |
| 5,096,122 | A | 3/1992 | Abramoska | |
| 5,179,753 | A | 1/1993 | Flaherty et al. | |
| 5,253,664 | A | 10/1993 | Wilson | |
| 5,333,448 | A | 8/1994 | Salecker | |
| 5,335,388 | A | 8/1994 | Salecker | |
| 5,379,476 | A | 1/1995 | Salecker | |
| 5,535,473 | A | 7/1996 | Maniar | |
| 5,588,171 | A | 12/1996 | Hamann | |
| 5,713,093 | A | 2/1998 | Enz | |
| 5,745,948 | A | 5/1998 | Lloyd et al. | |
| 5,813,089 | A * | 9/1998 | Nolan | E03F 9/005 239/443 |
| 5,862,568 | A | 1/1999 | Sjoberg | |
| 6,085,994 | A | 6/2000 | Zink | |
| 8,312,930 | B1 | 11/2012 | Glass | |
| 2005/0028306 | A1 | 2/2005 | Bergstrom | |
| 2018/0272394 | A1* | 9/2018 | Sieburg | B08B 9/0328 |

FOREIGN PATENT DOCUMENTS

| | | |
|---|---|---|
| FR | 1 597 870 | 6/1970 |
| KR | 10-1127272 B1 | 3/2012 |
| WO | WO 89/12513 | 12/1989 |

* cited by examiner

SELF-CENTERING CONDUIT CLEANING DEVICE WITH REDUCED AXIAL LENGTH

CROSS-REFERENCE TO RELATED APPLICATION

This application claims priority from and benefit of the filing date of U.S. Provisional Application Ser. No. 62/977,364 filed Feb. 16, 2020, and the entire disclosure of said provisional application is hereby expressly incorporated by reference into the present specification.

BACKGROUND

Self-centering conduit cleaning devices are generally known and have enjoyed widespread commercial success. For certain applications, known self-centering conduit cleaning devices have been found to be suboptimal because the axial length defined between the opposite forward and rear ends, combined with the axial length of an associated rigid hose coupling connected to and projecting outwardly from the rear end of the cleaning device is of a total length such that the combination of the device and the associated rigid hose coupling cannot navigate certain bends or corners in a conduit being cleaned. The rigid hose coupling connected to the rear end of the cleaning device body acts as a rigid tail that contacts the internal wall of the conduit being cleaned when the device navigates small radius bends and this contact can block further forward movement of the device through the bend of the conduit.

FIG. 1 (prior art) shows one example of a known self-centering conduit cleaning device 100 that has found widespread commercial success. The device 100 comprises a rigid body 100B including a liquid flow passage 100FP that extends axially therethrough. A rotor 100R is rotatably supported on a front end of the body 100B1 and is in fluid communication with the liquid flow passage 100FP. The rotor 100R is captured on the body 1008 by a cap washer CP and nut NT that is threaded onto a tip 100BT of the body 1008. The rotor 100R comprises fluid emitting nozzles 100N that project from an outer surface 100RS. The nozzles 100N comprise respective orifices 100X through which a high-pressure fluid stream is emitted for rotating the rotor and cleaning the inside of a conduit. One or more chains or other flexible or rigid members M are connected to the rotor 100R and clear debris from the conduit being cleaned. A rear end 100B2 of the body includes a hose fitting 100B5 for mating with a rigid hose coupling CX of a fluid supply hose such as a water hose. The body rear end 100B2 includes one or more thrust orifices (not shown) formed therein that are in communication with the body liquid flow passage 100FP and that each emit a high-pressure liquid stream that propels the body 100B forward in the conduit being cleaned. Between the forward and rear ends 100B1, 100B2 the body 100B comprises a rigid central portion 100B3 which can be cylindrical as shown and on which resilient radially enlarged elastomeric centering device CD is mounted. The centering device CD comprises a central core CC including a bore CB that extends axially therethrough and a plurality of fins or vanes CV that extend outwardly from the core CC. The bore CB of the core CC is coaxially positioned about the central portion 100B3 of the rigid body 100B with a close fit such that the core CC of the centering device CD cannot flex or otherwise move relative to the body 100B.

For certain applications, the device 100 of FIG. 1 has been found to be suboptimal because its rigid axial length 100L defined between its opposite forward and rear ends 100B1, 100B2 in combination with the axial length 100L' of an associated rigid hose coupling CX connected to the fitting 100B5 and the hose itself is such that the combination of the device 100 and the associated rigid hose coupling CX cannot navigate certain bends or corners in a conduit being cleaned. The core CC of the centering device CD cannot deflect or move relative to the body 100B due to its positioning on the rigid central portion 100B3 of the body 100B. The rigid hose coupling CX connected to the fitting 100B5 at the rear end 100B2 of the body 100B acts as a rigid tail that contacts the internal wall of the conduit being cleaned when the device navigates small radius bends and this contact can block further forward movement of the device 100 through the bend of the conduit.

SUMMARY OF THE PRESENT INVENTION

In accordance with one aspect of the present development, a conduit cleaning device comprises a body including a central portion, a forward portion comprising a neck, and a rear portion comprising a hose fitting adapted for connection to an associated hose. The body comprises a main flow passage that extends through the hose fitting, through the central portion, and into the neck. A rotor is rotatably supported on the neck and includes at least one rotor nozzle orifice in fluid communication with the main flow passage. A centering device is secured to the central portion of the body. The centering device comprises a core and a plurality of fins that project outwardly from said core. The core of the centering device comprises a mounting bore that extends therethrough, wherein at least part of the hose fitting is located within the mounting bore of the core and an annular space is defined between the hose fitting and an inner surface of said mounting bore of the core.

In accordance with another aspect of the present development, an apparatus for use in cleaning an associated conduit comprises a body including a central portion, a forward end comprising a neck, and a rear end comprising a hose fitting adapted for connection to an associated hose. The body comprises an axially extending main flow passage that extends through the hose fitting, through the central portion, and through the neck such that the main flow passage opens through both the forward and rear ends of the body. The neck comprises threads for connection of an associated conduit cleaning nozzle to the neck for fluid communication with the main flow passage. A centering device is connected to the body and comprises a core and a plurality of fins that project outwardly from the core. The core of the centering device includes a mounting bore, wherein at least part of the hose fitting is located within the mounting bore of the core and an annular space is defined between the hose fitting and an inner surface of the mounting bore of the core.

In accordance with a further aspect of the present development, a conduit cleaning device includes a body comprising a rear portion including a hose fitting adapted for connection to an associated hose. The body comprises a main flow passage that extends through the hose fitting. A centering device is secured to the body and comprises a core and a plurality of fins that project outwardly from the core. The core of the centering device includes a mounting bore, wherein at least part of the hose fitting is located within the mounting bore of the core and an annular space is defined between the hose fitting and an inner surface of the mounting bore of the core. The centering device includes a resilient elastomeric structure, and the core of the centering device is resiliently deflectable relative to the hose fitting. The body comprises at least one transverse flow passage that intersects and fluidically communicates with the main flow passage. The cleaning device further includes a thrust orifice in fluid communication with the transverse flow passage.

DETAILED DESCRIPTION OF THE PRESENT INVENTION

Figure 1:
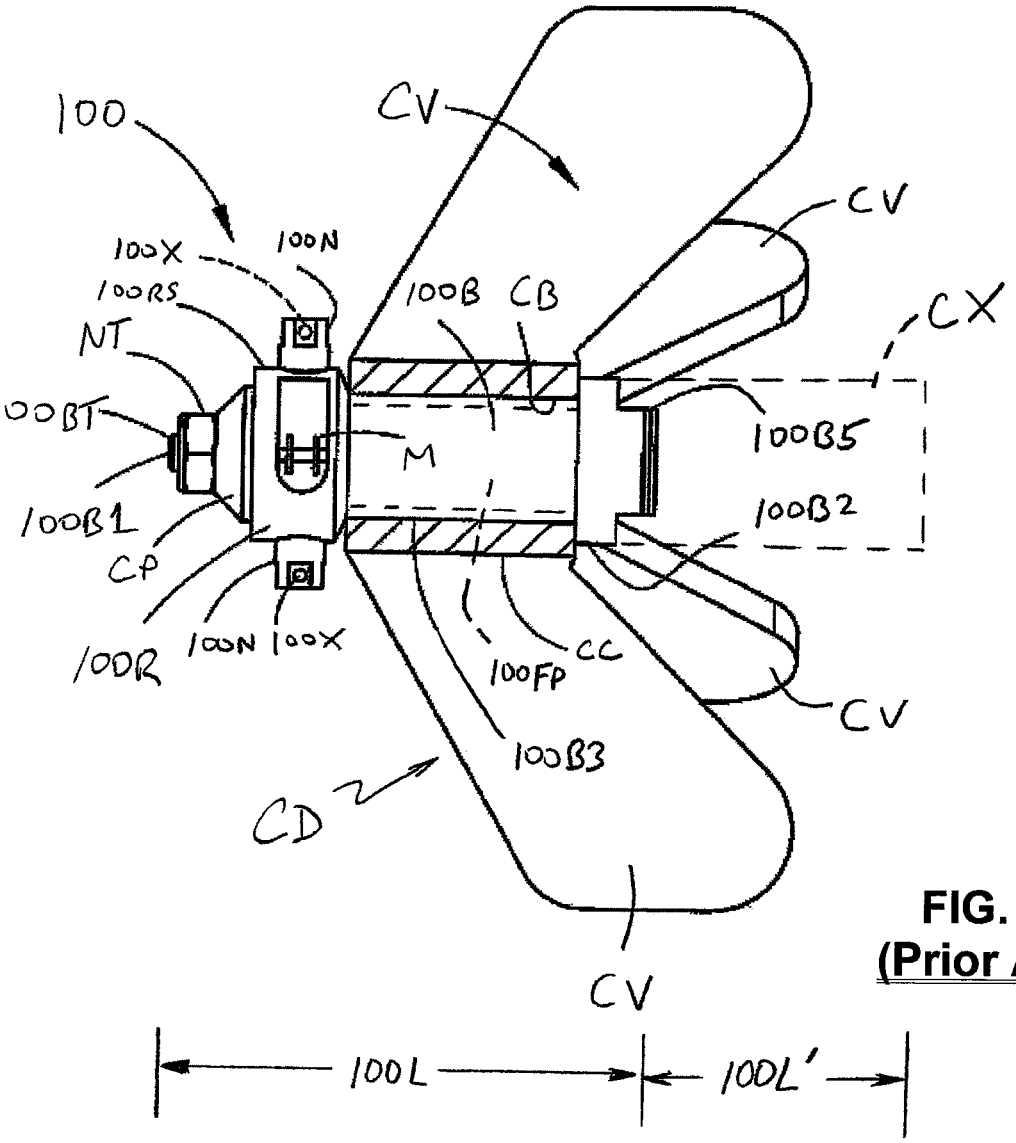
FIG. 1 (Prior Art)
FIG. 1 (prior art) is a side view of a known conduit cleaning device including a centering device, with part of the centering device broken away.
Figure 2:
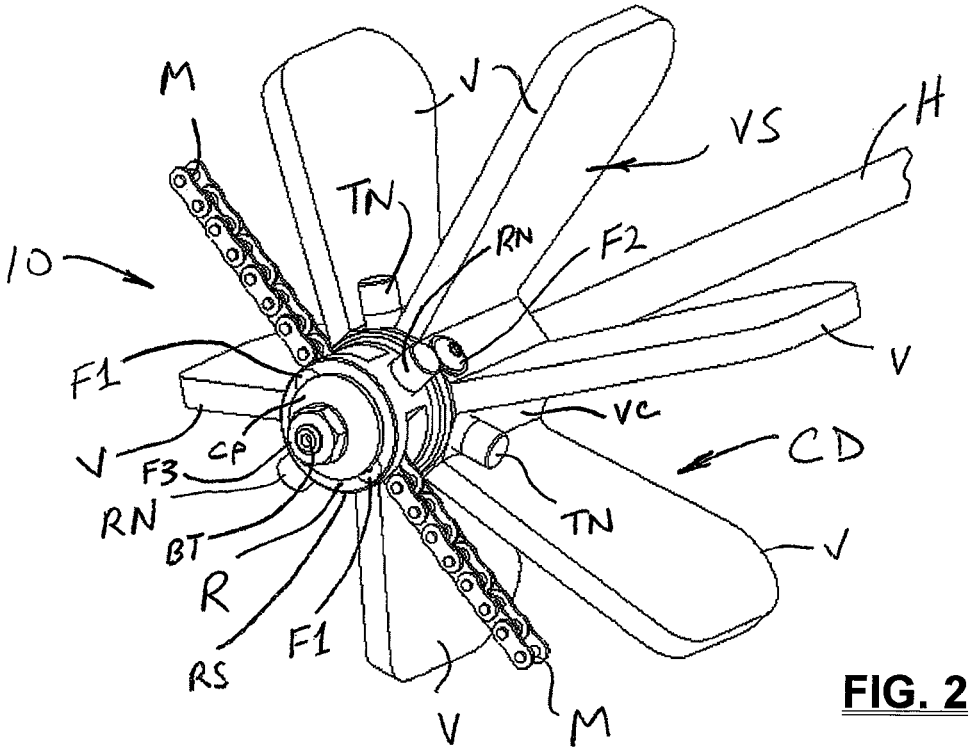
FIG. 2 is an isometric view of a conduit cleaning device formed in accordance with a first embodiment of the present development.
Figure 3:
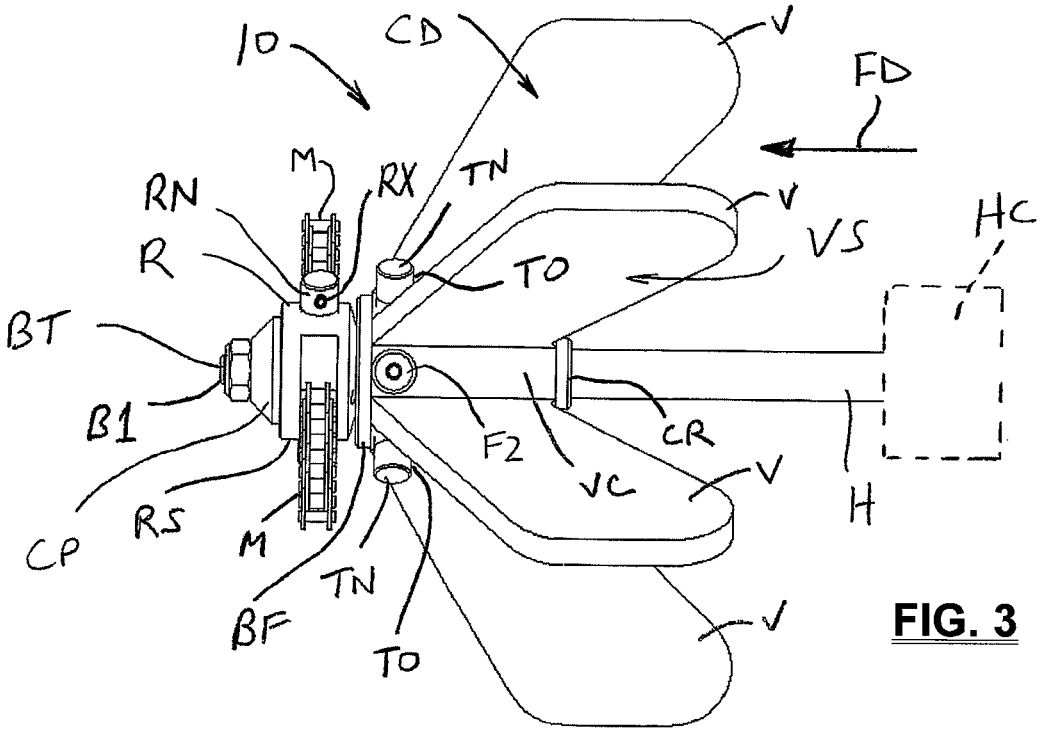
FIG. 3 is a side view of the cleaning device of FIG. 2.
Figure 4:
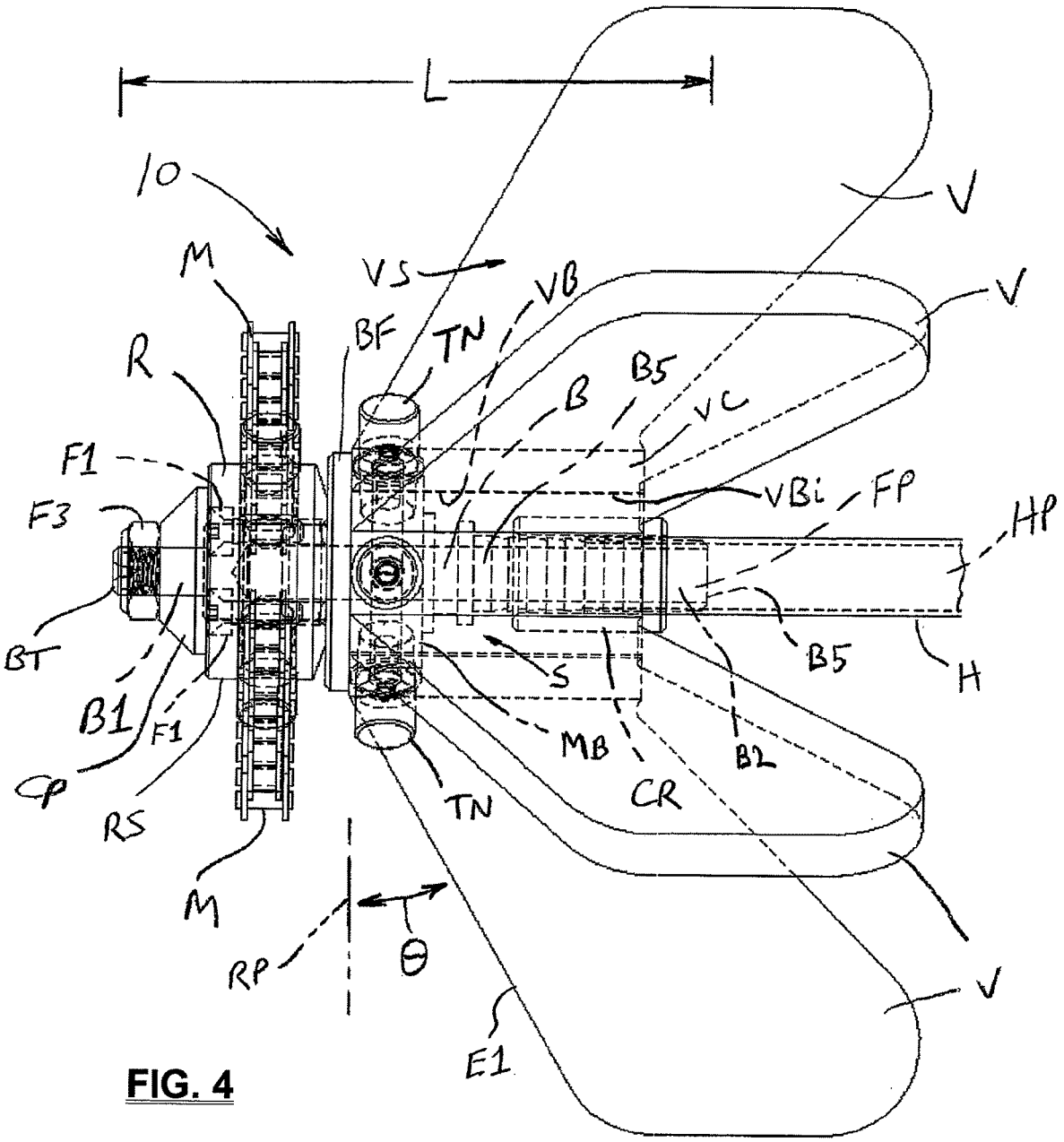
FIG. 4 is another side view of the cleaning device of FIG. 1, with hidden structures and components shown in broken lines.

FIGS. 2-4 illustrate a conduit cleaning device or apparatus 10 formed in accordance with a first embodiment of the present development. The device 10 comprises a stem or body B (shown separately in FIG. 5), a rotor R rotatably supported on and connected to the body B adjacent a first or forward end B1 of the body, and a centering device CD such as the illustrated vane structure VS or another suitable rigid or flexible centering device or means connected to the body B between the rotor R and a second or rear end B2 of the body B. In the illustrated embodiment, the rotor R includes at least one and preferably two or more rigid or flexible debris or root cutting or clearing members M such as chains or filaments that are connected to the rotor R by screws or other fasteners F1 (FIG. 1) or otherwise. If sufficiently rigid, the root cutting members M are self-supporting and continuously project radially outwardly from the rotor R otherwise, if flexible, they extend radially outwardly when the rotor R rotates due to centrifugal force.

The rotor R (shown separately in FIG. 8) further comprises at least one and preferably two or more rotor water outlet nozzles RN. The rotor nozzle(s) RN can be drilled or otherwise defined in the rotor R or as shown herein the nozzles RN are separate bodies that are each threadably or otherwise secured to the rotor R and that project radially outward from an outer surface RS of the rotor R. As shown, the rotor outer surface RS is cylindrical and the device 10 comprises first and second nozzles RN located at diametrically (180 degree) opposed locations relative to each other. If more than two rotor nozzles RN are included, they are preferably symmetrically spaced circumferentially about the rotor outer surface RS. Whether formed in or connected to the rotor R, each rotor nozzle RN includes a water outlet orifice RX (FIG. 2) and these orifices RX of the respective rotor nozzles RN are oriented relative to each other to discharge water W such that the discharged water causes the rotor R to rotate continuously relative to the body B about an axis of rotation that is coincident with a longitudinal axis X (FIG. 4) of the body B. The discharge angle of the orifices RX can be adjusted as described below to increase or decrease torque, with corresponding changes in speed, and cleaning effect (e.g., spray pattern, force) of the water streams discharges from the nozzle orifice RX.

Figure 5:
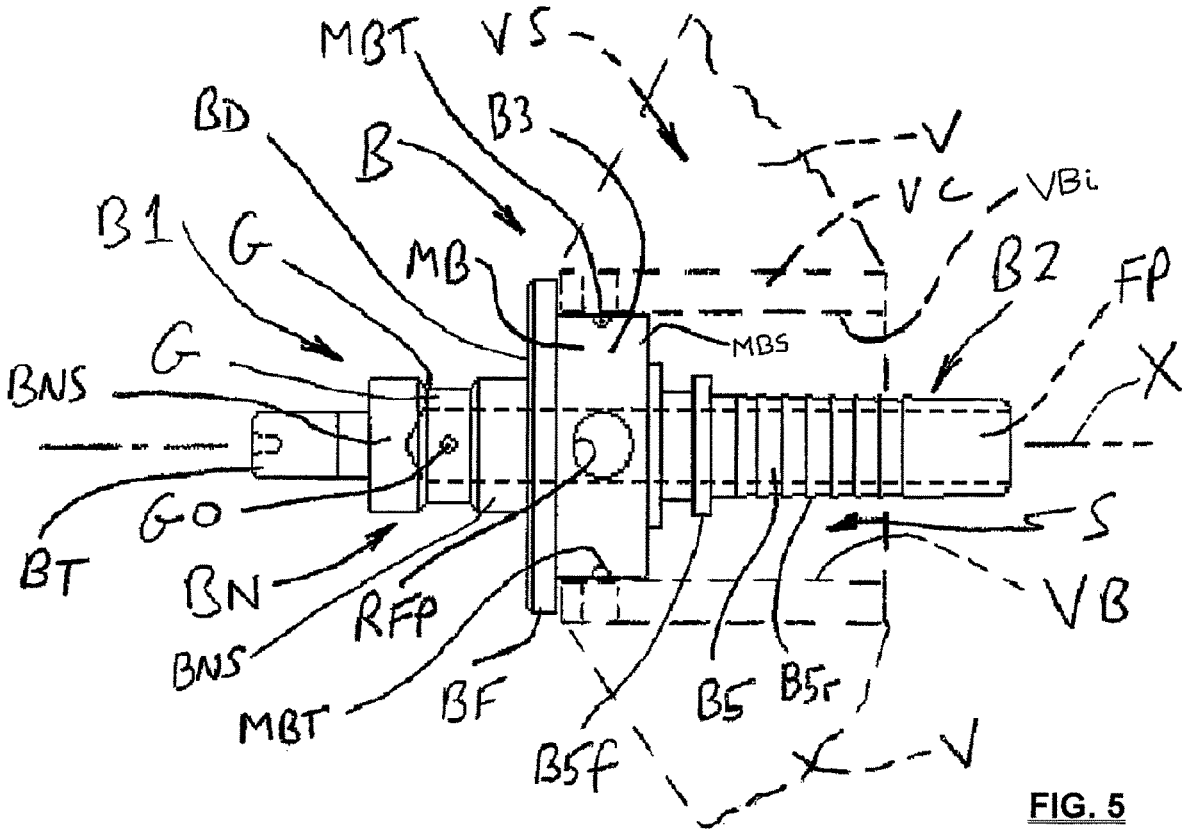
FIG. 5 is a side view of the body of the cleaning device of FIGS. 2-4, with the centering device partially shown in broken lines.

The stem/body B is shown in more detail in FIG. 5 and is defined from a stainless steel, aluminum or other metal structure that is preferably a one-piece structure. With particular reference to FIG. 5, the body B includes a central portion or main portion B3 located axially between the forward and rear ends B1, B2. The body main portion B3 comprises a mounting portion or mounting base MB on which the vane structure VS or other centering device is operably mounted and fixedly secured. The mounting base MB comprises an outer mounting surface MBS which can be cylindrical or non-cylindrical such as hexagonal or otherwise shaped. In the illustrated example, the mounting base MB comprises a plurality of tapped centering device mounting bores MBT defined therein and that each open through a cylindrical outside diameter or outer mounting surface MBS. As shown herein, three mounting bores MBT are provided and symmetrically positioned about the central longitudinal axis X. A corresponding plurality of mounting fasteners F2 (FIGS. 2 and 3) are engaged with the vane structure VS and are respectively threaded in the tapped mounting bores MBT to releasably and fixedly secure the vane structure VS to mounting surface MBS of the mounting base MB as described in more detail below.

As shown in FIG. 5 and explained in more detail below, the vane structure centering device VS comprises a central hollow core VC from which a plurality of vanes V project outwardly. The central core VC comprises a mounting bore VB that extends axially therethrough and defined by an inner bore wall VBi. The mounting base MB of the body B is closely received in the mounting bore VB of the centering device core VC such that the core VC is mounted on the mounting base MB, preferably coaxially with the longitudinal axis X. The inner surface VBi of the mounting bore VB is closely received on the mounting base outer surface MBS. The mounting base MB is axially much shorter than the core VC and mounting bore VB of the centering device such that at least a majority (for example, at least 50%-75% or more) of the core VC projects outwardly away from and is cantilevered or unsupported by the mounting base MB. One or more mounting fasteners F2 are engaged with the core VC of the vane structure VS and are respectively threaded in the tapped mounting bores MBT to releasably and fixedly secure the vane structure to mounting surface MBS of the mounting base MB (the fasteners F2 are omitted from FIG. 4 for clarity).

The body B further comprises a radially enlarged stop flange BF that projects outwardly from the mounting base MB axially between mounting surface MBS and the forward end B1 of the body B. The stop flange BF provides a shoulder or stop with which a forward end of the core VC of the centering device VS is abutted when the centering device VS is operatively mounted on the body B in its operative axial position. The stop flange BF defines the proper operative mounting position for the centering device core VC and also strengthens the connection between the centering device VS and the body B and reduces stress on the centering device VS at the location of the mounting fasteners F2 by countering axially forces acting between the core VC of the centering device VS and mounting base MB of the body B. The stop flange BF can define the largest radial dimension of the body B as shown herein and can be circular or include one or more flat surfaces at its periphery (e.g., comprise a hexagonal periphery) to facilitate engagement by a wrench or other tool.

Figure 9:
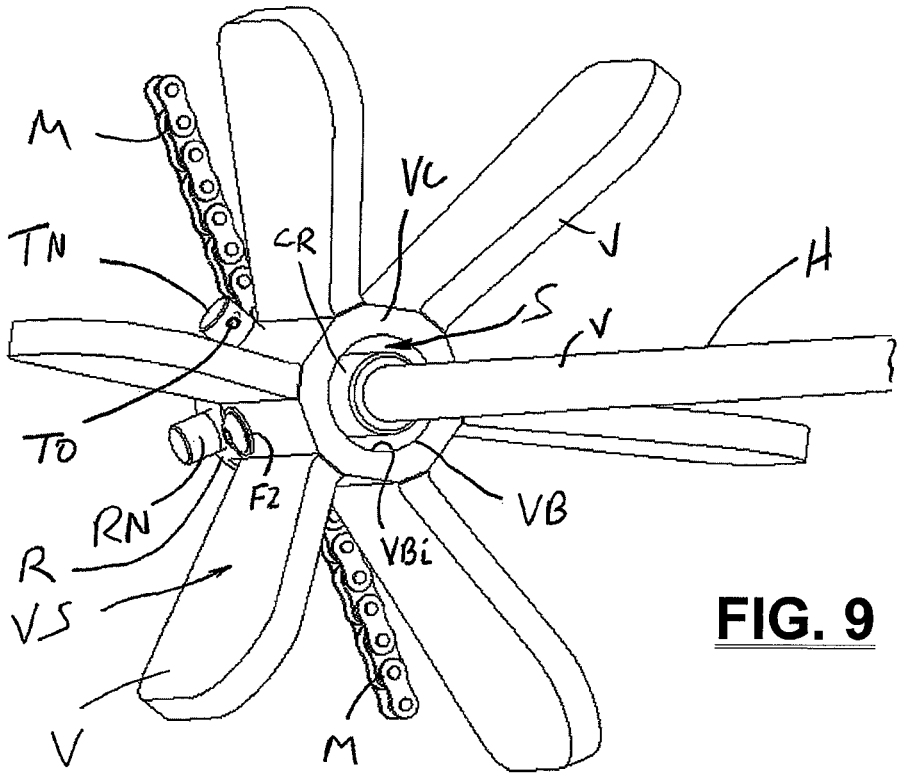
FIG. 9 is a rear isometric view of the cleaning device of FIGS. 2-4.

A longitudinally extending main liquid flow passage FP opens through the rear end B2 of the body B and extends through the body B toward the front end B1. In the illustrated embodiment, the flow passage BP does not extend through the front end B1 of the body B, but it can do so as described in more detail below. In some embodiments, the mounting base MB of the body B includes one or more transverse flow passages such as the illustrated radial flow passages RFP (FIGS. 5-7) that each fluidically intersect the main flow passage FP of the body B. In one preferred example, three such radial flow passages RFP are provided and are symmetrically positioned about the longitudinal axis X. A thrust nozzle TN is installed in each radial flow passage RFP of the base B. Each thrust nozzle TN extends through an aligned opening in the centering device core VC and includes a thrust orifice TO (see also the rear view of FIG. 9) oriented toward the second/rear end B2 of the body B such that high pressure liquid emitted through the thrust orifice TO will exert an opposite thrust force on the body B that will propel the body B in a forward direction FD through the conduit being cleaned. The centering device VS and thrust nozzles TN are circumferentially oriented relative to each other such that the thrust nozzles TN and thrust orifices TO thereof are located angularly between the vanes V so that the vanes V do not interfere with the high-pressure liquid flow emitted by the thrust nozzles TN.

Figure 6:
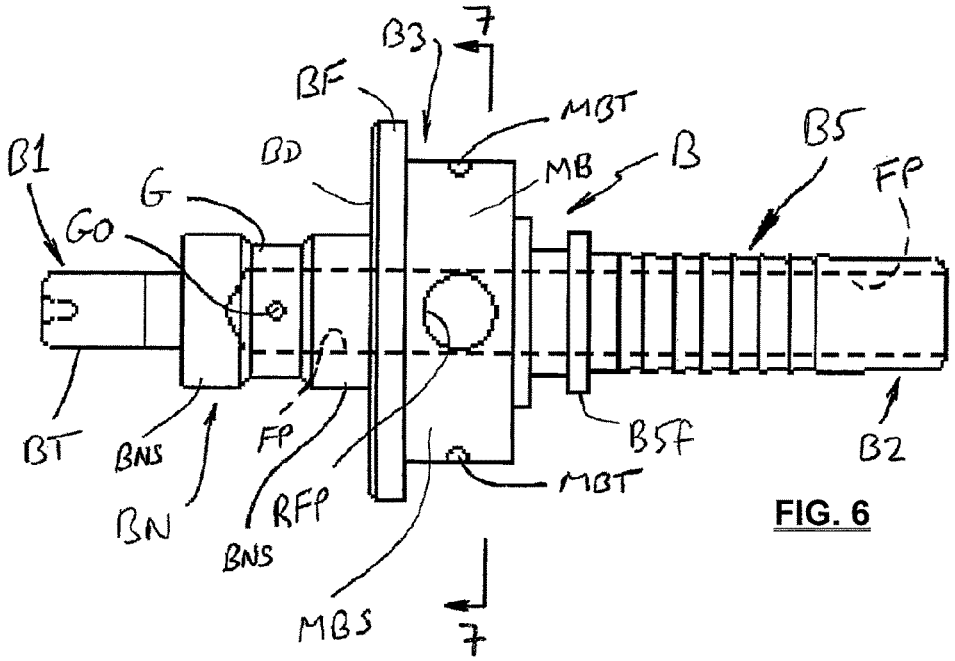
FIG. 6 is an enlarged side view of the body of the cleaning device of FIGS. 2-4 shown by itself.
Figure 7:
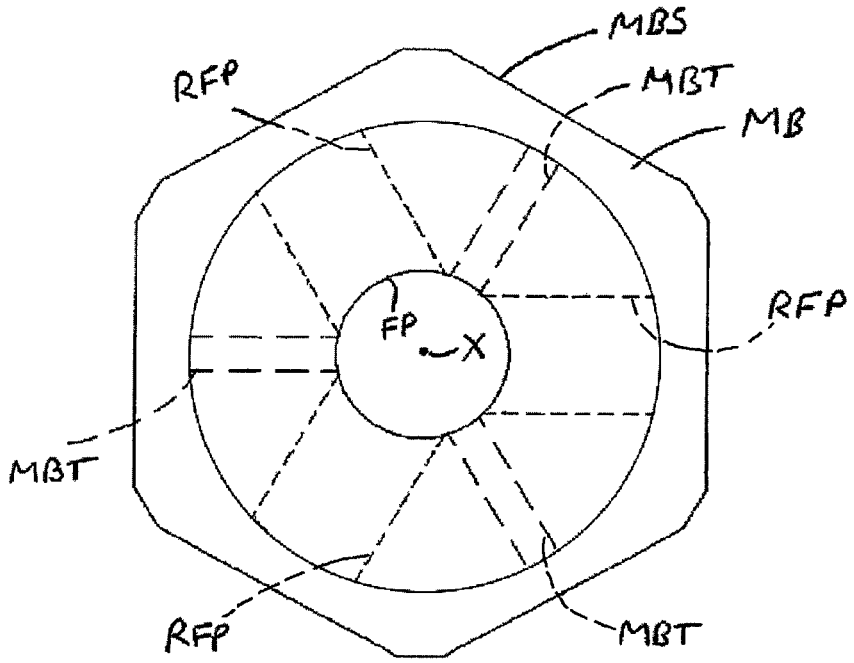
FIG. 7 is a section view as taken at line 7-7 of FIG. 6.

As noted above, in one example, three radial flow passages RFP and three respective thrust nozzles TN are provided, but more or less can be used. FIG. 6 provides an enlarged view of the body B, and FIG. 7 provides a section view taken at line 7-7 of FIG. 6. FIG. 7 shows that the three symmetrical radial flow passages RFP and three symmetrical tapped mounting bores MBT can be positioned in an alternating arrangement about the longitudinal axis X and can be aligned axially with each other (each having a central axis that lies in a reference plane perpendicular to the longitudinal axis X). In an alternative embodiment, the radial flow passages RFP are axially offset from the tapped mounting bores MBT, in which case they need not all be defined in the mounting base MB but either the mounting bores MBT or radial flow passaged RFP can be formed in another part of the central portion B3 of the body B such as in the flange BF. The tapped mounting bores MBT are shown in FIG. 7 as intersecting the main flow passage FP but they need not do so since they are blocked by the centering device mounting fasteners F2.

A hose fitting such as a nipple or barb B5 projects axially rearward from the mounting base MB away from the front end B1 toward the rear end B2 of the body B and is adapted to engage an associated hose H or other fluid carrying conduit in fluid communication such that the flow passage FP of the body B is in fluid communication with the hose H for supply of high-pressure water or another liquid can be supplied to the conduit cleaning device 10. The hose fitting B5 extends coaxially within the mounting bore VB of the core VC of the centering device VS such that an annular space S is defined between the hose fitting B5 and the inner surface VBi of the mounting bore VB.

In the illustrated embodiment, the hose fitting B5 comprises a barb that comprises an elongated tubular structure that can be cylindrical or otherwise configured in external shape and that is adapted to be inserted inside a hose passage or hose flow passage HP (FIG. 4) of the hose H such that the hose flow passage HP is fluidically connected to the body flow passage FP. The hose H is preferably a flexible hose comprising a reinforced polymeric structure or any other suitable hose. The barb B5 comprises one or a plurality of external raised ribs or other projections B5*r* (FIG. 5) that extend or project radially outward from its outer surface and that are adapted to frictionally engage the hose wall that defines the hose flow passage HP for securing the hose H on the barb B5. In the illustrated embodiment, the external projections comprise a plurality of axially spaced-apart circumferentially extending bite teeth that each are centered on the longitudinal axis X and that extend circumferentially about the barb B5. A radially enlarged crimp ring flange B5*f* is located between the projections B5*r* and the mounting base MB and can optionally be engaged by an associated crimp collar or ring.

In the illustrated example, a crimp collar or crimp ring CR preferably made from metal is coaxially positioned about the hose H and barb fitting B5 and is radially compressed to fixedly secure the hose H in its operative position mated with the barb B5 for fluid communication between the hose flow passage HP and the body flow passage FP. In an alternative embodiment (not shown) part of the crimp ring CR is compressed around the crimp ring flange B5*f*. The operatively installed crimp ring CR forms a hose coupling that fixedly operatively secures the hose H on the barb B5 such that the hose H supplies water or other liquid to the cleaning device 10 via main flow passage FP. Preferably, at least 50% of the axial length of the crimp ring CR and preferably 75% or more (such as 100%) of the axial length of the crimp ring CR is located inside the centering device mounting bore VB so that the crimp ring CR does not form a long rigid tail that projects axially away from the rear B2 of the device 10 that would reduce its cornering ability as described above. As shown diagrammatically in FIG. 2, an opposite end of the hose H can comprise a coupling HC that is adapted to mate with another hose coupling or valve or other supply of water or other cleaning liquid.

As best seen in FIGS. 5 and 6, the forward end B1 of the body B includes a neck or neck portion BN that projects outwardly (forwardly) from the stop flange BF of the central portion B3 toward the forward end B1 on the axial side opposite the mounting base MB. The neck BN is reduced in diameter relative to the stop flange BF and central portion B3 such that a shoulder BD is defined. The neck portion BN includes at least one cylindrical outer surface BNs. The neck portion BN also includes an external annular groove G defined in its cylindrical outer surface. At least one orifice GO is located in the groove G and fluidically connects the groove G to the main internal axial flow passage FP of the body B. In the illustrated embodiment, the annular groove G separates first and second cylindrical portions of the neck BN from each other. The main internal axial flow passage FP of the body B passes through the neck BN, central portion B3, and hose barb B5 and opens through the second or rear end B2 of the body B. As shown, the main internal flow passage FP of the body B is defined as a cylindrical bore centered on the longitudinal axis X of the body that is coincident with the axis of rotation of the rotor R.

Figure 8:
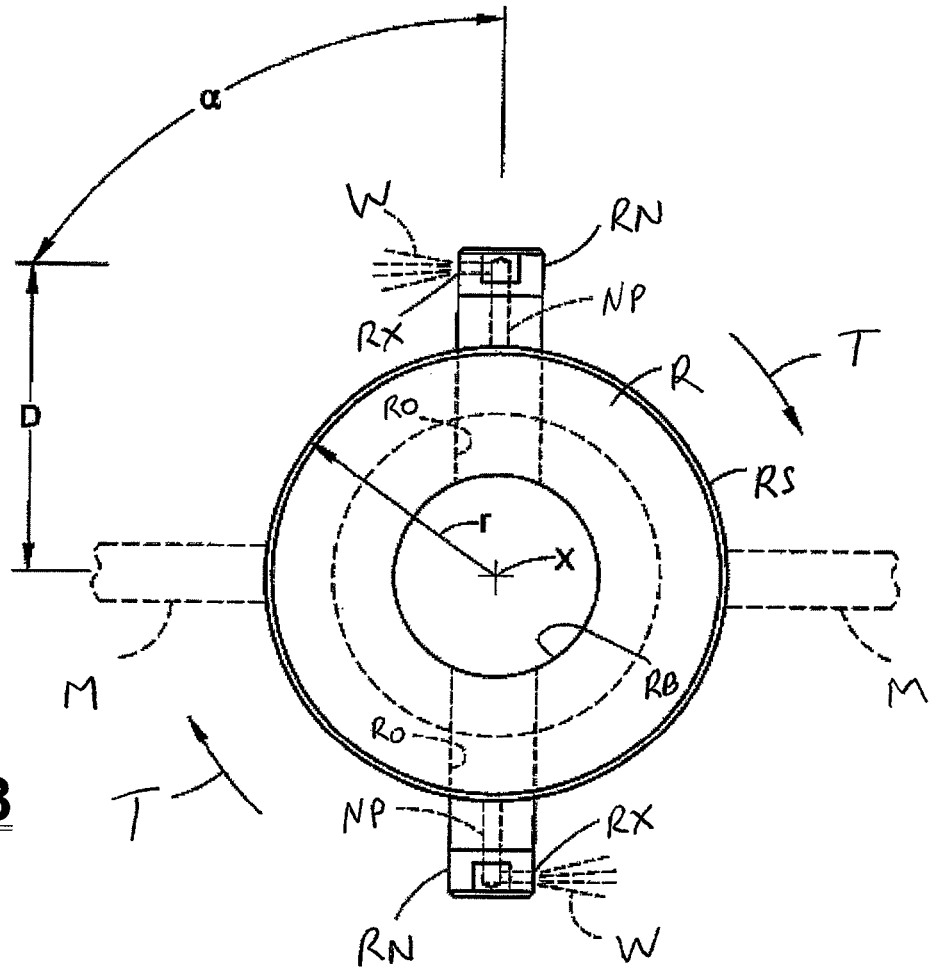
FIG. 8 is a front view of a rotor of the cleaning device of FIGS. 2-4.

The rotor R, also shown by itself in FIG. 8, includes a central through-bore RB, at least part of which is defined with a cylindrical surface. The through-bore RB of the rotor R is closely received on the cylindrical surfaces BNs of the neck BN such that the rotor R is rotatable on the body B. When the rotor R is installed on the body neck BN, at least one cylindrical portion BNS of the neck BN is axially aligned with a cylindrical portion of the through-bore RB. The rotor R includes one or more and preferably two radial outlet bores RO that open at an inner end into the through-bore RB and that open at an outer end through the rotor outer surface RS. When the rotor R is installed on the body B, the neck BN is closely received in the rotor through-bore RB with minimal clearance while still allowing relative rotation, and the rotor R is located adjacent the body transverse shoulder BD. In this operative position, the radial outlet bores RO of the rotor R are aligned with the annular groove G of the neck BN so as to be in fluid communication with the annular groove G of the neck BN, and such that high-pressure water from the body main flow passage FP flows into the groove G through the groove orifice GO and from there into the radial outlet bores RO of the rotor R. Preferably the rotor R includes first and second radial outlet bores RO located at diametrically opposed locations in the rotor R, but more bores RO can be included and are preferably symmetrically arranged about the through bore RB. In an alternative embodiment, the rotor through-bore RB includes an internal annular groove defined in its inside diameter that intersects the rotor radial outlet bores RO and that is aligned with the orifice GO defined in the neck BN when the rotor R1 is installed on the neck BN, in which case the annular groove G of the neck BN can be eliminated if desired.

As noted above, referring now particularly to FIG. 8, the rotor R comprises at least one and preferably two or more water outlet nozzles RN that are threaded into the outer ends of the radial outlet bores RO. Each rotor nozzle RN includes a water outlet orifice RX in fluid communication with the associated rotor outlet bore RO by an internal nozzle flow passages NP. The rotor nozzle outlet orifices RX are oriented to discharge water W in a common angular orientation relative to each other such that the water W discharged there through causes the rotor R to rotate relative to the body B in the direction opposite the orientation of the nozzle outlet orifices RX as indicated by the arrows T. Each nozzle outlet orifice RX is oriented at a discharge angle $\alpha$ relative to a radial reference line that extends coaxially with the associated radial outlet bore RO in which the nozzle N is installed, and this discharge angle $\alpha$ can be adjusted as desired within a range of 5 degrees (less rotor torque, lower rotor speed) to 90 degrees (more rotor torque, higher rotor speed) such that $5° < \alpha < 90°$. This change of the discharge angle $\alpha$ (and/or other changes such as the diameter of the nozzle outlet orifice RX and/or the diameter of the nozzle flow passages NP) can be made by simply unthreading and replacing the nozzles RN with new nozzles having the desired discharge angle $\alpha$ and other flow characteristics, without otherwise altering the rotor R. Another main advantage is that the nozzle outlet orifices RX are spaced from the axis of rotation X (which is also the longitudinal axis of the body/stem B) a distance D that is much greater than the maximum radius r of the rotor R (or the maximum distance between the axis of rotation X and the rotor outer surface RS if the rotor outer surface RS is not cylindrical), which increases the torque that is induced in the rotor R by the discharged water W and which also decreases the space between the nozzle water outlets RX and the walls of a conduit being cleaned when the rotor R is used in a conduit having a large inside diameter relative to the rotor outside diameter. Preferably, the distance D is at least equal to the maximum radius r of the rotor R+0.25 inches.

The body B also includes a tip BT at its first end B1. The tip BT can be externally and/or internally threaded. A cap or cap washer CP (FIGS. 1 & 2) is installed on the tip BT of the body adjacent the rotor R and a nut F3 or other fastener is threadably secured to the body tip BT to secure the cap washer CP in place and thus axially capture the rotor R on the body B without inhibiting rotation of the rotor R. Additional bearings, bushings, sleeves washers, etc. can be installed between the rotor R and the body B and/or between the rotor R and the cap washer CP. Also, the cap washer CP and nut F3 can be replaced by a nut, clip and/or other structure connected to the body tip BT to capture the rotor R rotatably on the neck B.

As noted above, the conduit cleaning device 10 includes any suitable centering device CD to center the device 10 in an associated pipe or other conduit being cleaned. The centering device CD, such as the illustrated vane structure VS, is much larger in diameter than the body B such that the centering device VS supports the body B away from the walls of the conduit being cleaned. If the maximum outside diameter of the centering device VS is minimally smaller than the conduit being cleaned, the cleaning device 10/body B will be approximately centered in the conduit for optimum cleaning performance. The centering device VS can be rigid or flexible, and the illustrated flexible vane structure VS is merely one example of a suitable centering means. The vane structure VS is installed on the mounting portion MB of the body B adjacent and in abutment with the flange BF. In the illustrated embodiment, the vane structure VS comprises a one-piece resilient elastomeric structure comprising the hollow central core VC and a plurality of vanes V that are connected to and that project radially outward from the core VC, preferably spaced evenly from each other in terms of their angular orientation about a central longitudinal axis of the core VC, and the central axis of the core VC is coincident with the longitudinal axis X of the body B and axis of rotation X of the rotor R when the vane structure VS is operatively installed on the body B. Thus, the vanes V are spaced evenly at 360/Z degrees, where Z=the total number of individual vanes V projecting from the core VC (the spacing is 60 degrees in the present example).

The central core VC comprises a through-bore VB that is closely and frictionally fitted on the outer surface of the body mounting base MB and the hollow core VC projects outwardly from the mounting base B in an unsupported or cantilevered manner. At least one fastener F2 is installed through the wall of the core VC and engaged with one of the mounting apertures MBT of the mounting base MB of the body B to operatively secure the core VC on the body B, although the centering device VS can alternatively be secured to the mounting base MB of the body with a friction fit, adhesive, and/or using other suitable convenient means. The central mounting bore VB of the core VC is closely received on the centering device mounting base MB. The external surface of the centering device mounting base MB and the internal surface VBi of the core VC that defines the bore VB can both be cylindrical, or they can alternatively by otherwise correspondingly shaped such as square, hexagonal, or otherwise shaped to match each other.

The vane structure VS preferably comprises a one-piece resilient elastomeric structure in which the core VC and the vanes V are defined by a single one-piece structure that is cast, molded, extruded, or otherwise manufactured. In one example, the vane structure VS comprises a resilient polyurethane composition, but other materials can alternatively be used. In a natural or free state, each vane V projects radially from the core VC, in a respective radial plane, a like distance such that the vane structure VS locates the device A coaxially or at least substantially coaxially within an associated cylindrical conduit being cleaned. In use, each vane V is resiliently deflectable at least circumferentially in opposite first and second circumferential directions toward and away from adjacent vanes V. This circumferential deflectability of each vane V allows the vane structure VS to change shape and/or allows each vane V to reduce its maximum radial distance from the core as needed for the device A to negotiate bends or deformations or obstructions in a conduit being cleaned as the vane structure VS moves forward and rearward through the conduit being cleaned. When external deformation force exerted on each vane V is removed, the vane V automatically resiliently returns to its natural, undeflected state.

The vanes V are each preferably swept back relative to a reference plane RP that perpendicularly intersects the longitudinal axis X of the body B. Thus, each vane V includes a leading edge E1, and a linear portion or tangent to the leading edge E1 is offset from the reference plane by a sweepback angle Θ that is at least 10 degrees and preferably in the range of 10 to 55 degrees, e.g., 45 degrees. The material from which the vane structure VS is defined, its dimensions are selected such that the sweepback angle Θ remains at least substantially constant during use.

The inside diameter or inside dimension of the bore VB of the centering device core VC is larger than the outside diameter of the hose fitting B5. The conduit cleaning device 10 thus includes an annular space S defined between the inner bore wall VBi of the centering device core VC and the hose fitting B5 (and hose H), and at least more than 50% and preferably more than 75% of the hose fitting B5 is located inside (axially recessed inside) the bore VB of the centering device core VC to reduce a rigid axial length L (FIG. 4) of the device A as defined between the forward/front tip BT of the body B and the rear end B2 of the body B. The open annular space S defined between the hose H (or hose fitting B5 if the hose H is not installed) and the inner wall VBi of the centering device core VC allows the centering device core VC to resiliently flex toward and away from the hose fitting B5 of the body B. The location of the hose fitting B5 at least substantially recessed inside the bore VB of the core VC of the centering device VS such that the core VC of the centering device VS circumferentially surrounds at least a majority (at least 50% and preferably at least 75% and optionally 100%) of the axial length of the hose fitting B5 reduces the rigid axial length L of the cleaning device 10 and eliminates a rigid hose fitting that projects outwardly away from the rear end B2 of the device 10 (such as the fitting CX of FIG. 1) and allows the device 10 including the hose H to bend in a smaller radius as compared to prior devices, which allows the device A to pass through tighter bends/corners of a conduit being cleaned. Furthermore, as noted, at least 50% of the axial length of the crimp ring CR and preferably 75% or more (such as 100%) of the axial length of the crimp ring CR is located inside the centering device mounting bore VB so that the crimp ring CR does not form a long rigid tail that projects axially away from the rear B2 of the device 10 that would reduce its cornering ability as described above.

Figure 10:
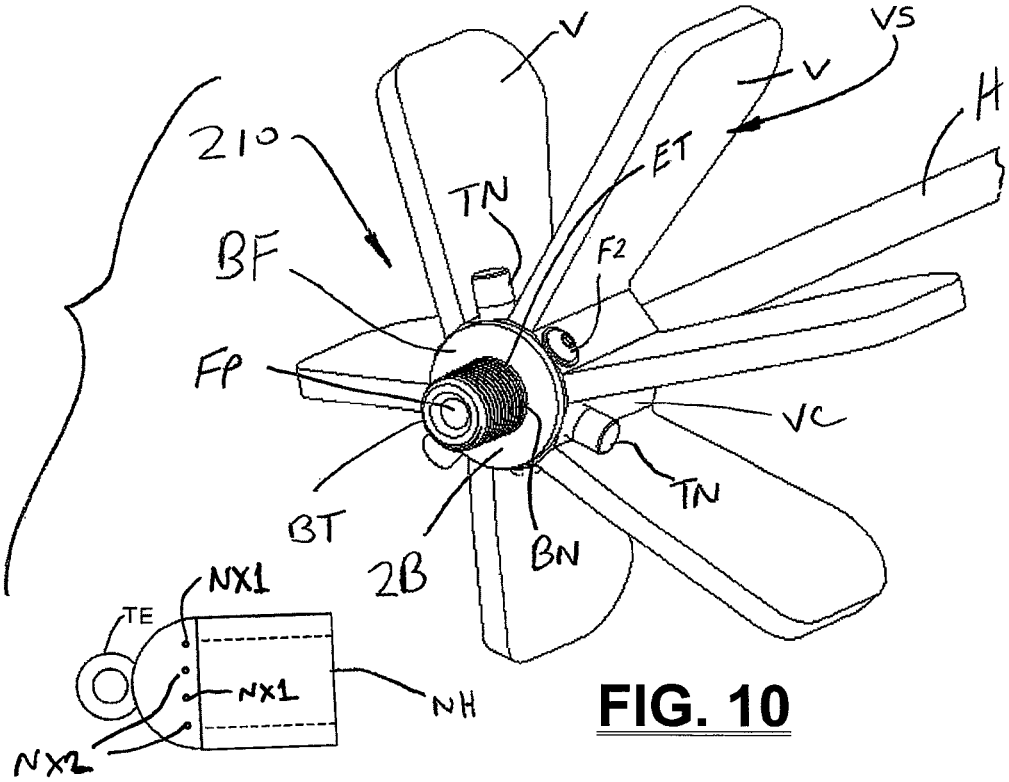
FIG. 10 shows a cleaning device formed in accordance with an alternative embodiment of the present development.

FIG. 10 is similar to FIG. 2 but shows an alternative device or apparatus 210 that is the same as the device 10 except as otherwise shown and/or described. The device 210 includes a body 2B in which the main flow passage FP extends completely through and between the forward and rear ends B1, B2 of the body B, completely through the neck BN. The neck BN is configured with external threads ET to for attachment of an associated nozzle head NH that communicates with the flow passage FP. The associated nozzle head NH can optionally include a tow hook/tow eye TE adapted to be engaged by a cable, chain or other tow device for pulling the device 210 through a conduit being cleaned. The nozzle head NH affixed to the threaded neck BN may include one or more thrust orifices NX1, in which case the thrust nozzles TN can optionally be omitted. The nozzle head NH may one or more cleaning orifices NX2 for directing high-pressure liquid jets against the inner wall of the conduit being cleaned.

Figure 11:
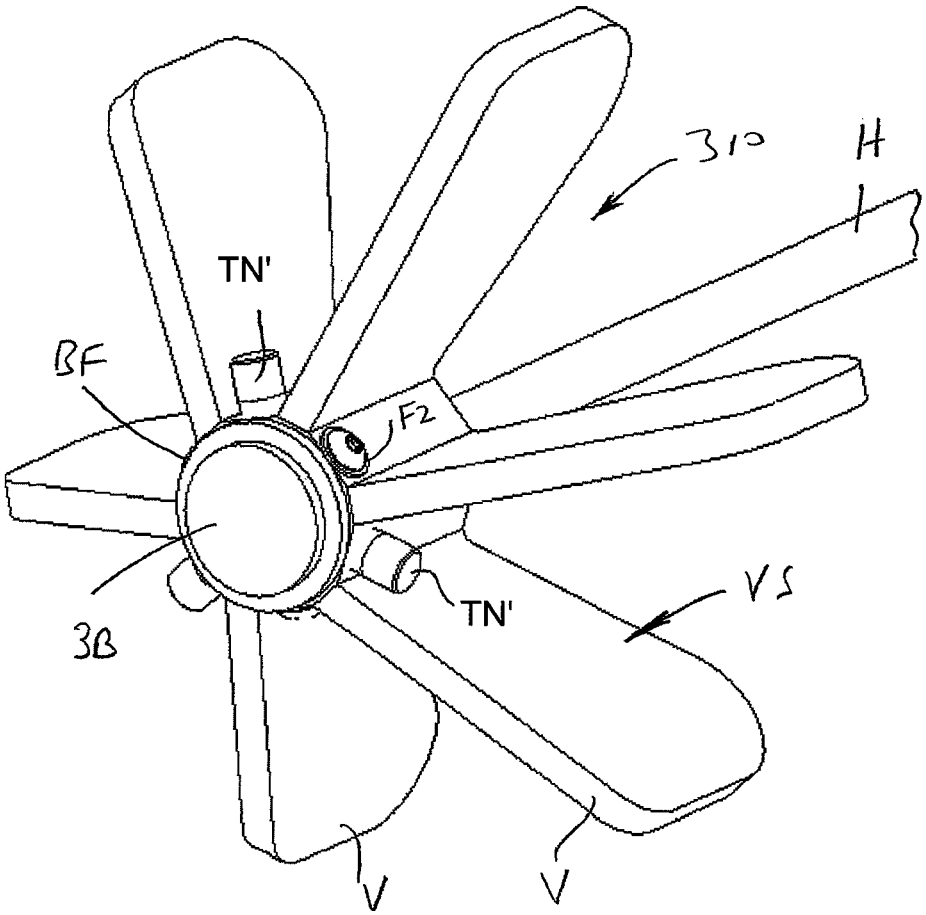
FIG. 11 shows a cleaning device formed in accordance with another alternative embodiment of the present development.

FIG. 11 is similar to FIG. 10 but shows a device or apparatus 310 that is the same as the device 210 except as otherwise shown and/or described. The device 310 includes a body 3B in which in which the neck BN is omitted. The device 310 includes nozzles TN' which direct high pressure water streams rearwardly and/or outwardly toward the inner walls of the conduit being cleaned to clean the conduit inner walls and/or propel the device 310 forward through the conduit. Additionally or alternatively, the body 3B comprises one or more passages drilled or otherwise formed therein in fluid communication with the main flow passage FP for emitting a high-pressure liquid stream supplied from the flow passage FP for propelling the device 310 forward and/or for cleaning the inner wall of the conduit being cleaned.

The disclosure has been described with reference to the exemplary embodiments. Modifications and alterations will occur to others upon reading and understanding the preceding detailed description, and it is intended that the claims be construed as broadly as possible to include all such modifications and alterations while maintaining the validity of the claims.

The invention claimed is:

1. A conduit cleaning device comprising:

a body comprising a central portion, a forward portion comprising a neck, and a rear portion comprising a hose fitting adapted for connection to an associated hose;

said body comprising a main flow passage that extends through said hose fitting, through said central portion, and into said neck;

a rotor rotatably supported on said neck and comprising at least one a rotor nozzle orifice in fluid communication with said main flow passage;

a centering device secured to said central portion of said body, said centering device comprising a core and a plurality of fins that project outwardly from said core, said core of said centering device comprising a mounting bore that extends therethrough, wherein at least part of said hose fitting is located within said mounting bore of said core and an annular space is defined between said hose fitting and an inner surface of said mounting bore of said core.

2. The conduit cleaning device as set forth in claim 1, wherein said centering device comprises a resilient elastomeric structure and wherein said core of said centering device is resiliently deflectable relative to said hose fitting.

3. The conduit cleaning device as set forth in claim 2, wherein said resilient elastomeric structure comprises a one-piece polyurethane structure.

4. The conduit cleaning device as set forth in claim 3, wherein said hose fitting comprises an elongated tubular structure including one or more external raised ribs.

5. The conduit cleaning device as set forth in claim 4, further comprising a hose operably connected to said hose fitting, wherein said elongated tubular structure is inserted into a hose passage that extends through said hose.

6. The conduit cleaning device as set forth in claim 5, further comprising a crimp ring coaxially positioned about said hose and said hose fitting in said space defined between said hose fitting and said inner surface of said mounting bore.

7. The conduit cleaning device as set forth in claim 6, wherein at least a majority of an axial length of said crimp ring is located within said space.

8. The conduit cleaning device as set forth in claim 2, wherein said mounting bore of said centering device core and said main flow passage are coaxially arranged with respect to a longitudinal axis of said body.

9. The conduit cleaning device as set forth in claim 2, wherein said hose fitting comprises an axial length and wherein at least a majority of said axial length of said hose fitting is located inside said core of said centering device.

10. The conduit cleaning device as set forth in claim 9, wherein said centering device comprises a resilient one-piece structure and wherein said core of said centering device is resiliently deflectable relative to said hose fitting.

11. The conduit cleaning device as set forth in claim 1, wherein said central portion of said body comprises at least one transverse flow passage that intersects and fluidically communicates with said main flow passage, said cleaning device further comprising a thrust orifice in fluid communication with said transverse flow passage.

12. The conduit cleaning device as set forth in claim 1, wherein said central portion of said body comprises a plurality of transverse flow passages that each intersects and fluidically communicate with said main flow passage, said cleaning device further comprising a plurality of thrust orifices respectively in fluid communication with said plurality of transverse flow passages.

13. The conduit cleaning device as set forth in claim 12, further comprising:

a centering device mounting bore located in said body central portion;

a centering device fastener located in said centering device mounting bore and engaged with said centering device to operatively secure said centering device on said body.

14. The conduit cleaning device as set forth in claim 12, further comprising:

a plurality of a centering device mounting bores located in said body central portion, wherein said plurality of centering device mounting bores and said plurality of transverse flow passages are arranged circumferentially about said longitudinal axis in an alternating arrangement with respect to each other.

15. The conduit cleaning device as set forth in claim 14, wherein said central portion of said body comprises a mounting base to which said centering device is connected, wherein said plurality of mounting bores and said plurality of transverse flow passages are located in said mounting base.

16. The conduit cleaning device as set forth in claim 15, wherein said mounting base is inserted into said mounting bore of said core of said centering device and wherein at least a majority of an axial length of said core of said centering device projects outwardly from and is unsupported by said mounting base such that said core of said centering device is cantilevered relative to said mounting base.

17. The conduit cleaning device as set forth in claim 1, further comprising at least one debris clearing member connected to the rotor.

18. An apparatus for use in cleaning an associated conduit, said apparatus comprising:

a body comprising a central portion, a forward end comprising a neck, and a rear end comprising a hose fitting adapted for connection to an associated hose;

said body comprising an axially extending main flow passage that extends through said hose fitting, through said central portion, and through said neck such that said main flow passage opens through both said forward and rear ends of the body;

said neck comprising threads for connection of an associated conduit cleaning nozzle to said neck for fluid communication with said main flow passage;

a centering device connected to said body, said centering device comprising a core and a plurality of fins that project outwardly from said core, said core of said centering device comprising a mounting bore, wherein at least part of said hose fitting is located within said mounting bore of said core and an annular space is defined between said hose fitting and an inner surface of said mounting bore of said core.

19. A conduit cleaning device comprising:

a body comprising a rear portion including a hose fitting adapted for connection to an associated hose;

said body comprising a main flow passage that extends through said hose fitting;

a centering device secured to said body, said centering device comprising a core and a plurality of fins that project outwardly from said core, said core of said centering device comprising a mounting bore, wherein at least part of said hose fitting is located within said mounting bore of said core and an annular space is defined between said hose fitting and an inner surface of said mounting bore of said core;

said centering device comprising a resilient elastomeric structure and said core of said centering device being resiliently deflectable relative to said hose fitting;

said body comprises at least one transverse flow passage that intersects and fluidically communicates with said main flow passage;

said cleaning device further comprising a thrust orifice in fluid communication with said transverse flow passage.

* * * * *